US009837758B1

(12) United States Patent
Huang

(10) Patent No.: US 9,837,758 B1
(45) Date of Patent: Dec. 5, 2017

(54) ANTI-LOOSE DATA CABLE

(71) Applicant: Joining Free Technology Co., Ltd., Shenzhen, Guangdong (CN)

(72) Inventor: Wenxuan Huang, Guangdong (CN)

( * ) Notice: Subject to any disclaimer, the term of this patent is extended or adjusted under 35 U.S.C. 154(b) by 0 days.

(21) Appl. No.: 15/466,886

(22) Filed: Mar. 23, 2017

(30) Foreign Application Priority Data

Jan. 4, 2017 (CN) ..... 2017 2 0005656 U

(51) Int. Cl.

| | |
|---|---|
| ***H01R 13/648*** | (2006.01) |
| ***H01R 13/58*** | (2006.01) |
| ***H01R 24/64*** | (2011.01) |
| ***H01R 43/26*** | (2006.01) |
| *H01R 107/00* | (2006.01) |

(52) U.S. Cl.
CPC ..... *H01R 13/582* (2013.01); *H01R 24/64* (2013.01); *H01R 43/26* (2013.01); *H01R 2107/00* (2013.01)

(58) Field of Classification Search
CPC ..... H01R 13/41; H01R 13/6658; H01R 13/65802
USPC ..... 439/733.1, 620.1, 607.1
See application file for complete search history.

(56) References Cited

U.S. PATENT DOCUMENTS

| | | | | |
|---|---|---|---|---|
| 7,753,712 | B2 * | 7/2010 | Miki | H01R 13/6275 439/352 |
| 8,430,577 | B2 * | 4/2013 | Sun | H01R 13/41 385/88 |
| 2004/0033726 | A1 * | 2/2004 | Kao | G06K 19/07732 439/660 |
| 2010/0279526 | A1 * | 11/2010 | Chiang | H01R 27/00 439/131 |

* cited by examiner

*Primary Examiner* — Phuong Chi T Nguyen

(57) ABSTRACT

An anti-loose data cable contains: an interface element, a first protective fixing layer, a second protective fixing layer, a third protective fixing layer, a positioning head, and a USB cable. The interface element is welded with the USB cable, on a connection area of the interface element and the USB cable is fixed the first protective fixing layer, and the interface element and the first protective fixing layer are accommodated in the second protective fixing layer, wherein a main part of the second protective fixing layer is accommodated in the third protective fixing layer, and the third protective fixing layer and the positioning head are integrally formed together.

4 Claims, 3 Drawing Sheets

ANTI-LOOSE DATA CABLE

FIELD OF THE INVENTION

The present invention relates to an anti-loose data cable.

BACKGROUND OF THE INVENTION

A conventional data cable is applied to connect a mobile device to a computer so as to transfer data or messages, such as video, ringtones, or pictures.

The conventional data cable has a COM interface and a USB interface, wherein the COM interface is also called a serial port which is connected on a back surface of the computer. The COM interface is cheap and supports flashing of a custom ROM, but it is removed difficultly and cannot support a notebook computer. In addition, the COM interface transfers data slowly. The USB interface is popular, transfers data quickly, and supports various computers. However, the integrated circuit of the USB interface is expensive and a part of the data cables cannot support flashing of the custom ROM.

Furthermore, the positioning head and a rotary head of the conventional data cable are broken easily, and a main body of the conventional data cable cannot connect with the USB cable reliability.

The present invention has arisen to mitigate and/or obviate the afore-described disadvantages.

SUMMARY OF THE INVENTION

The primary objective of the present invention is to provide an anti-loose data cable which is not broken easily.

Further objective of the present invention is to provide an anti-loose data cable of which the positioning head is not detached from the anti-loose data cable.

Another objective of the present invention is to provide an anti-loose data cable which is simplified and is manufactured at low fabrication cost.

To obtain above-mentioned objectives, an anti-loose data cable provided by the present invention contains: an interface element, a first protective fixing layer, a second protective fixing layer, a third protective fixing layer, a positioning head, and a USB cable.

The interface element is welded with the USB cable, on a connection area of the interface element and the USB cable is fixed the first protective fixing layer, and the interface element and the first protective fixing layer are accommodated in the second protective fixing layer, wherein a main part of the second protective fixing layer is accommodated in the third protective fixing layer, and the third protective fixing layer and the positioning head are integrally formed together.

Preferably, the first protective fixing layer is injection molded from polypropylene (PP), the second protective fixing layer is injection molded from acrylonitrile butadiene styrene (ABS), and the third protective fixing layer is injection molded from thermoplastic elastomers (TPE).

Preferably, a peripheral tab of the second protective fixing layer exposes outside the third protective fixing layer.

Preferably, the interface element is a common USB interface or a USB Type-C interface.

Preferably, the anti-loose data cable is manufactured through injection molded three times so as to form three protective layers. A method of manufacturing the anti-loose data cable contains steps of:

A. welding the interface element and the USB cable together;

B. injection molding the first protective fixing layer from polypropylene (PP), injection molding the interface element and the USB cable together, and fixing the first protective fixing layer, the interface element, and the USB cable together;

C. injection molding the second protective fixing layer from acrylonitrile butadiene styrene (ABS) so as to accommodate the interface element and the first protective fixing layer firmly and to avoid the USB cable removal from the interface element; and D. injection molding the third protective fixing layer from thermoplastic elastomers (TPE) so that the third protective fixing layer accommodates the second protective fixing layer securely, the interface element and the first protective fixing layer are accommodated in the second protective fixing layer firmly, and the interface element and the USB cable are connected together securely by way of the first protective fixing layer.

Thereby, the interface element is protected by the first protective fixing layer, the second protective layer, and the third protective layer safely. In addition, the positioning head is not detached from the third protective fixing layer, because and the third protective fixing layer and the positioning head are integrally formed together.

Preferably, the USB cable is welded with the interface element and is accommodated in the first protective fixing layer, the second protective fixing layer, and the third protective fixing layer stably.

DETAILED DESCRIPTION OF THE PREFERRED EMBODIMENTS

Figure 1:
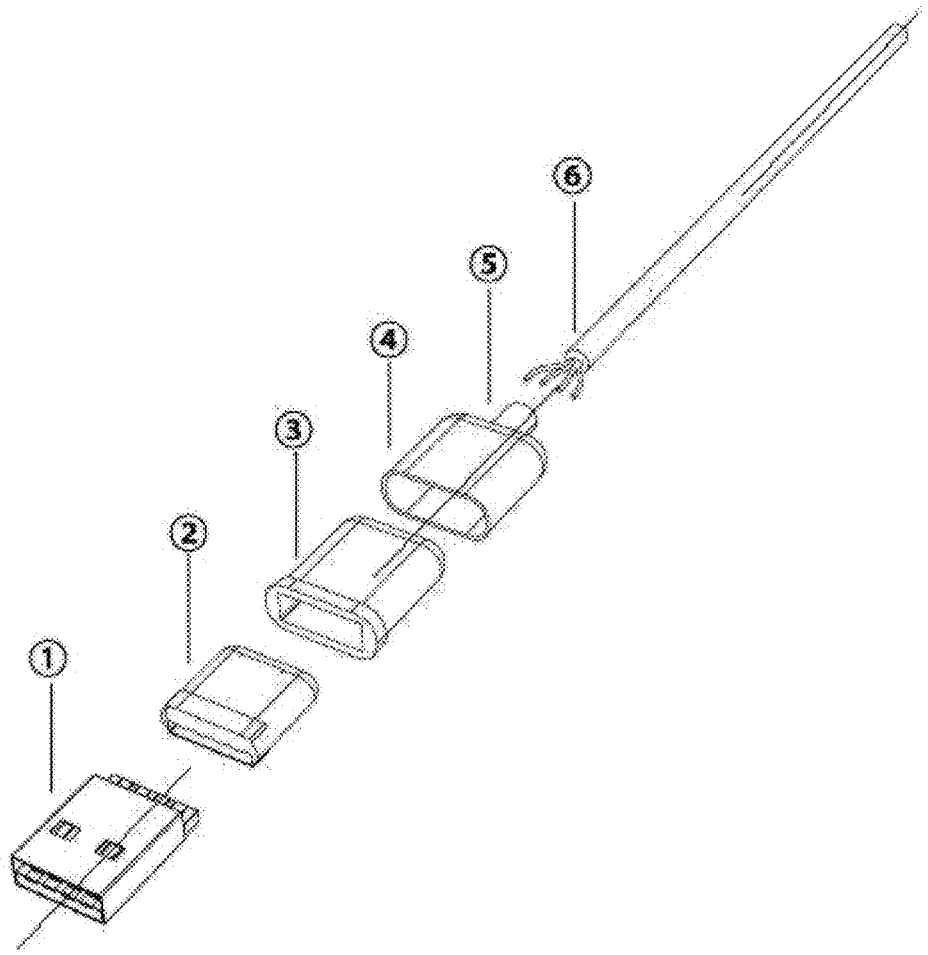
FIG. 1 is a perspective view showing the exploded components of an anti-loose data cable according to a preferred embodiment of the present invention.
Figure 2:
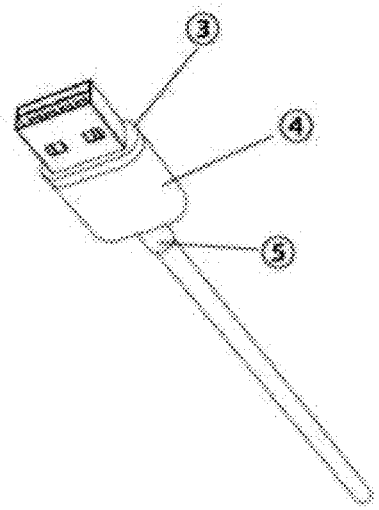
FIG. 2 is a perspective view showing the assembly of the anti-loose data cable according to the preferred embodiment of the present invention, wherein the interface element is a common USB interface.
Figure 3:
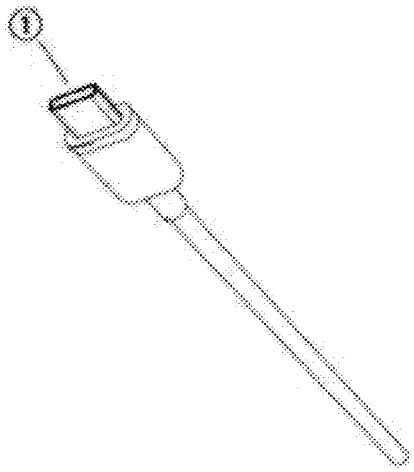
FIG. 3 is a perspective view showing the assembly of the anti-loose data cable according to the preferred embodiment of the present invention, wherein the interface element is a USB Type-C interface.
Figure 4:
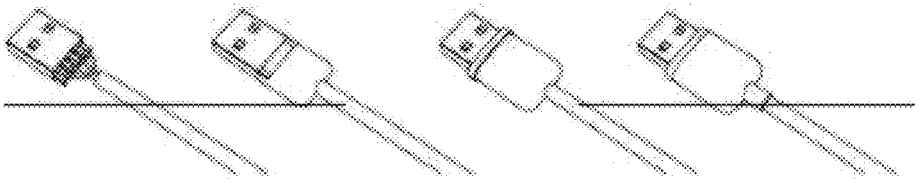
FIG. 4 is a perspective view showing the operation of the anti-loose data cable according to the preferred embodiment of the present invention.

With reference to FIGS. 1-4, an anti-loose data cable according to a preferred embodiment of the present invention comprises: an interface element 1, a first protective fixing layer 2, a second protective fixing layer 3, a third protective fixing layer 4, a positioning head 5, and a USB cable 6. The interface element 1 is welded with the USB cable 6, and on a connection area of the interface element 1 and the USB cable 6 is fixed the first protective fixing layer 2, and the interface element 1 and the first protective fixing layer 2 are accommodated in the second protective fixing layer 3, wherein a main part of the second protective fixing layer 3 is accommodated in the third protective fixing layer 4, and the third protective fixing layer 4 and the positioning head 5 are integrally formed together.

Preferably, the first protective fixing layer 2 is injection molded from polypropylene (PP), the second protective fixing layer 3 is injection molded from acrylonitrile butadiene styrene (ABS), and the third protective fixing layer 4 is injection molded from thermoplastic elastomers (TPE).

Preferably, a peripheral tab of the second protective fixing layer 3 exposes outside the third protective fixing layer 4 so as to obtain aesthetic appearance.

Preferably, the interface element 1 is a common USB interface or a USB Type-C interface.

Preferably, the anti-loose data cable is manufactured through injection molded three times so as to form three protective layers. A method of manufacturing the anti-loose data cable comprises steps of:

A. welding the interface element 1 and the USB cable 6 together;

B. injection molding the first protective fixing layer 2 from polypropylene (PP), injection molding the interface element 1 and the USB cable 6 together, and fixing the first protective fixing layer 2, the interface element 1, and the USB cable 6 together;

C. injection molding the second protective fixing layer 3 from acrylonitrile butadiene styrene (ABS) so as to accommodate the interface element 1 and the first protective fixing layer 2 firmly and to avoid the USB cable 6 removal from the interface element 1; and D. injection molding the third protective fixing layer 4 from thermoplastic elastomers (TPE) so that the third protective fixing layer 4 accommodates the second protective fixing layer 3 securely, the interface element 1 and the first protective fixing layer 2 are accommodated in the second protective fixing layer 3 firmly, and the interface element 1 and the USB cable 6 are connected together securely by way of the first protective fixing layer 2. Thereby, the interface element 1 is protected by the first protective fixing layer 2, the second protective layer 3, and the third protective layer 4 safely. In addition, the positioning head 5 is not detached from the third protective fixing layer 4, because and the third protective fixing layer 4 and the positioning head 5 are integrally formed together. Preferably, the USB cable 6 is welded with the interface element 1 and is accommodated in the first protective fixing layer 2, the second protective fixing layer 3, and the third protective fixing layer 4 stably.

Accordingly, the anti-loose data cable is not broken easily, and the positioning head is not detached from the anti-loose data cable. Preferably, the anti-loose data cable is simplified and is manufactured at low fabrication cost.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An anti-loose data cable comprising: an interface element, a first protective fixing layer, a second protective fixing layer, a third protective fixing layer, a positioning head, and a USB cable;

wherein the interface element is welded with the USB cable, on a connection area of the interface element and the USB cable is fixed the first protective fixing layer, and the interface element and the first protective fixing layer are accommodated in the second protective fixing layer, wherein a main part of the second protective fixing layer is accommodated in the third protective fixing layer, and the third protective fixing layer and the positioning head are integrally formed together.

2. The anti-loose data cable as claimed in claim 1, wherein the first protective fixing layer is injection molded from polypropylene (PP), the second protective fixing layer is injection molded from acrylonitrile butadiene styrene (ABS), and the third protective fixing layer is injection molded from thermoplastic elastomers (TPE).

3. The anti-loose data cable as claimed in claim 1, wherein a peripheral tab of the second protective fixing layer exposes outside the third protective fixing layer.

4. The anti-loose data cable as claimed in claim 1, wherein the interface element is a common USB interface or a USB Type-C interface.

* * * * *